US006824218B1

(12) United States Patent
van Hekken

(10) Patent No.: US 6,824,218 B1
(45) Date of Patent: Nov. 30, 2004

(54) HEIGHT ADJUSTMENT MECHANISM FOR A CHAIR

(75) Inventor: Hendrik R. van Hekken, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 10/769,061

(22) Filed: Jan. 30, 2004

(51) Int. Cl.[7] ..... A47C 7/54
(52) U.S. Cl. ..... 297/411.36; 403/108
(58) Field of Search ..... 297/411.36, 353; 248/118, 118.3, 125.3, 297.31, 407, 423; 403/105–108

(56) References Cited

U.S. PATENT DOCUMENTS

| | | | | |
|---|---|---|---|---|
| 979,149 | A | | 12/1910 | Gay |
| 1,210,199 | A | | 12/1916 | Passeck |
| 1,400,960 | A | | 12/1921 | Lambert |
| 1,569,708 | A | | 1/1926 | Bums et al. |
| 2,256,856 | A | | 9/1941 | Zwald |
| 2,830,653 | A | | 4/1958 | Gaugler |
| 3,162,416 | A | | 12/1964 | Amarillos |
| 4,043,592 | A | | 8/1977 | Fries |
| 4,451,084 | A | | 5/1984 | Seeley |
| 4,639,039 | A | | 1/1987 | Donovan |
| 4,660,885 | A | | 4/1987 | Suhr et al. |
| 4,749,230 | A | | 6/1988 | Tornero |
| 5,037,158 | A | | 8/1991 | Crawford |
| 5,388,892 | A | * | 2/1995 | Tornero ..... 297/411.36 |
| 5,393,125 | A | | 2/1995 | Watson et al. |
| 5,435,626 | A | | 7/1995 | Lai |
| 5,439,267 | A | | 8/1995 | Peterson et al. |
| 5,597,204 | A | * | 1/1997 | Karaus, Jr. ..... 297/353 |
| 5,620,233 | A | | 4/1997 | Corwin |
| 5,649,741 | A | * | 7/1997 | Beggs ..... 297/353 |
| 5,676,483 | A | | 10/1997 | Koubek |
| 5,725,278 | A | | 3/1998 | Verbeek |
| 5,735,577 | A | | 4/1998 | Lin |
| 5,765,920 | A | | 6/1998 | Lai |
| 5,938,285 | A | | 8/1999 | Verbeek |
| 5,951,107 | A | | 9/1999 | Tornero |
| 6,053,579 | A | | 4/2000 | Nelson et al. |
| 6,209,840 | B1 | * | 4/2001 | Chen ..... 248/407 |
| 6,209,961 | B1 | * | 4/2001 | Chen ..... 297/411.36 |
| 6,276,757 | B1 | | 8/2001 | Brown |
| 6,315,362 | B1 | | 11/2001 | Chuang |
| 6,343,840 | B1 | * | 2/2002 | Chuang ..... 297/411.36 |
| 6,394,553 | B1 | | 5/2002 | McAllister et al. |
| 6,709,059 | B1 | * | 3/2004 | Cvek ..... 297/353 |

* cited by examiner

*Primary Examiner*—Peter R. Brown
(74) *Attorney, Agent, or Firm*—Buchanan Ingersoll PC

(57) ABSTRACT

An adjustable armrest and height adjustment mechanism. The adjustable arm rest has a fixed member having a housing, a vertically adjustable member having a post slidably disposed in the housing, and a sleeve disposed intermediate the post and the housing. The height adjustment mechanism can include a camming slot formed in the post, an angled slot formed in the sleeve member on opposite sides of the camming slot, a locking pin positioned through each of the camming and angled slots, and a bushing projecting into the angled slot and defining upper and lower regions thereof in which the locking pin can be held. The locking pin is movable between respective notches responsive to upward vertical movement of said post such that the vertically adjustable member is held at a height corresponding to each notch until further upward vertical movement of the post.

15 Claims, 6 Drawing Sheets

HEIGHT ADJUSTMENT MECHANISM FOR A CHAIR

BACKGROUND

This invention relates generally to height adjustable portions of chairs, and particularly, to a height adjustment mechanism for a movable portion of a chair. More particularly, the invention relates to an adjustable armrest assembly. However, the height adjustment mechanism may also be used for other adjustable portions of a chair, including, for example, the back rest, or potentially even the seat.

A wide variety of adjustable office chairs are presently available. In an attempt to adapt the chair to a particular user or task, various adjustment mechanisms have been provided. Such chairs may, for example, include vertically adjustable seat height mechanisms, swivel tilt mechanisms, and vertically adjustable height mechanisms for armrests and backrests.

Prior art armrest and backrest height adjustment mechanisms are available in various forms. In some, manually operable mechanisms, such as using buttons or handles, which require manipulation of a release/lock member prior to being able to adjust the arm or back rest portion. Examples of adjustable height armrests are described in U.S. Pat. No. 6,394,553 to McAllister, et al, and U.S. Pat. No. 5,393,125 to Watson, et al.

Prior art mechanisms for height adjustable chair backrests are known which can operate "automatically," in the sense that no release or lock member need be manually operated prior to attempting to move the adjustable portion of the chair. In these types of mechanisms, the adjustable backrest can be raised or lowered and the adjustment mechanism operates automatically to maintain the backrest in the adjusted position.

One example of such an "automatic" vertical adjustment mechanism for a chair backrest is described in U.S. Pat. No. 4,749,230 to Tornero. The mechanism described in this patent generally comprises two guided and slidably interlocking plates and one lock pin. The lock pin is free to move within a sinus-shaped slot defined within one plate and forced therewith from one locked position to a stand-by position, or to an unlocked position by the cam action of any of a plurality of notches and inclined surfaces of a slotted cam contained on the other plate. According to Tornero, this mechanism is characterized by the absence of springs or other supplementary biasing means. Instead of a spring member, the position of the pin in the sinus-shaped slot is controlled by a series of camming surfaces similar to the notches and inclined surfaces of the cooperating slotted cam plate. However, there is nothing which retains the pin in any of the positions other than the shape of the slot. This particular means of controlling the pin using the shape of the slot can have disadvantages. For example, rapid or overly forceful adjustment of the backrest could displace the lock pin to an unlocked position, which would require moving the backrest to the full up position in order to re-set the lock pin in a position where the adjustment process could be repeated. In addition, the shape of the slot holds the pin in each of the three positions, rather than using springs or gravity. Thus, camming surfaces, activated by manual force, are employed to move the pin between the three positions defined by the shape of the slot. Another potential disadvantage of this type of design can be in regard to securing the position of the pin in a particular position in the slot to prevent the pin from inadvertently dislodging from the notch in the slotted cam plate, such as, for example, by excessive or rapid application of force to the backrest, sudden movement, or jarring of the backrest or chair.

Another example of an "automatic" vertical adjustment mechanism for a chair backrest is described in U.S. Pat. No. 5,037,158 to Crawford ("the '158 patent"), assigned to the assignee of the present invention. The mechanism described in the '158 patent comprises a vertical member containing a centrally located camming slot that is elongated in a vertical direction and has a series of notches located along one side and a smooth surface located along the other side. The top and bottom of the camming slot contain downwardly directed camming surfaces. A back adjustment plate includes a centrally located horizontal slot and a guide pin positioned within the slot supported by an S-shaped leaf spring. When the guide pin is moved in either direction away from the central axis of the slot, the leaf spring causes the pin to be biased in the direction that the pin has been moved away from. In order to raise the chair back relative to the seat, the chair back is grasped by the user and pulled in an upward direction whereupon the pin is urged in the direction of the notches and registers in each of the notches as the chair back is moved in an upward direction. In order to lower the seat back, the seat back is raised fully which causes the pin to be urged in the direction of the smooth surface. As the pin rides along the upper surface in the direction of the smooth surface, the pin will pass the halfway point in the slot and spring will urge the pin in the direction of the surface. One advantage of this particular mechanism can be greater smoothness of operation (and thus less force to adjust the backrest) because the slot in which the pin rides is smooth, since no camming surfaces are used to control the position of the pin therein. Other advantages can include reliability, in that the leaf spring can more positively control the position of the pin in the slot, making it more likely that the pin will be maintained in the desired position, and less likely to dislodge from that position, for example, such as by sudden movement or jarring of the chair. However, the need for the leaf spring member itself can be a disadvantage, because it is an additional small moving part, and it increases the cost of the mechanism.

Consequently, there is a need for a height adjustment mechanism for adjustable portions of a chair, specifically the armrest, but also potentially the backrest or seat, wherein the height adjustment mechanism is simple, easy to use, and at the same time highly reliable and less costly. The present invention is directed toward filling that need.

SUMMARY

An adjustable armrest assembly is provided comprising a fixed member having a chair attachment portion and a housing portion, a vertically adjustable member having an armrest portion and a post portion, with the post portion having a lower end thereof slidably disposed in the housing portion, and the vertically adjustable member is selectively movable between a fully raised position, a fully lowered position, and at least one intermediate position via a height adjustment mechanism.

The height adjustment mechanism comprises a first member having a housing portion and a support portion, a second vertically adjustable member having an upper end and a lower end, the lower end being slidably disposed in the housing portion, and the lower end further having a camming slot formed therein. The camming slot has a plurality of notches on one side thereof and a generally planar surface on an opposing side. A sleeve member can be provided in between the housing and the post, with an inner surface of the sleeve member adjacent opposite sides of the camming slot. The sleeve member can have an angled slot formed in the inner surface thereof on opposite sides of the camming slot, such that a locking pin can be operably positioned through both the camming and angled slots, with opposite ends of the locking pin slidably captured in the angled slot. A bushing member can be provided in the sleeve member such that the bushing member projects at least partially into the angled slot such that upper and lower regions of the angled slot are defined by the bushing member. The upper region of the angled slot is adjacent the generally planar surface of the camming slot, whereas the lower region is adjacent the plurality of notches. The camming slot further has top and bottom surfaces, wherein the top surface forces the locking pin across the bushing member into the lower region of the angled slot at the fully lowered position, and the bottom surface forces the locking pin across the bushing member into the upper region of the angled slot at the fully raised position. The locking pin being maintained in either the upper or lower regions by the bushing member until otherwise caused to move across the bushing member by the bottom or top surface. When the locking pin is maintained in the lower region of the angled slot, gravity urges the locking pin toward the plurality of notches, such that the locking pin is urged into one of the plurality of notches when such one of the notches becomes aligned with the lower region of the angled slot, as will occur responsive to upward vertical movement of the armrest. The armrest is held at a height corresponding to the notch occupied by the locking pin. The locking pin is moveable from whichever notch is occupied responsive to further upward vertical movement of the armrest, up to the fully raised position, at which the locking pin will be urged away, by the bottom surface of the camming slot, from the notched side of the camming slot into the upper region of the angled slot by the bottom surface of the camming slot. The locking pin will be maintained, by the bushing member, in the second region of the angled slot until the armrest is moved to the fully lowered position, which will result in the top surface of the camming slot moving the locking pin back across the bushing member into the lower region of the angled slot. At this point, the locking pin is positioned to repeat the selectable vertical adjustment process by upward vertical movement of the armrest.

The adjustable armrest assembly/height adjustment mechanism, can also be provided with one or more compression members disposed between the outer surface of the sleeve member and the inside surface of the housing portion. The sleeve member can also be a pair of sleeve members and the bushing member can be a pair of bushing members, each associated with a respective sleeve member. The bushing members can partially project only into the angled slot formed in the sleeve member, and not into the camming slot, such that the bushing members contact only the ends of the locking pin which are slidably captured in the angled slot.

The adjustable armrest assembly of can further comprise an arm pad which is securable to the armrest portion and has a resiliently flexible insert member. The resiliently flexible insert member can be a thin plate-like member having a width and length substantially the same as the arm pad. The thin plate-like member can be made from spring steel, or an appropriate plastic or other material having resiliently flexible properties.

Other details, objects, and advantages of the invention will become apparent from the following detailed description and the accompanying drawing figures of certain embodiments thereof.

BRIEF DESCRIPTION OF THE DRAWING FIGURES

A more complete understanding of the invention can be obtained by considering the following detailed description in conjunction with the accompanying drawings, in which.

DETAILED DESCRIPTION OF CERTAIN EMBODIMENTS

Figure 1:
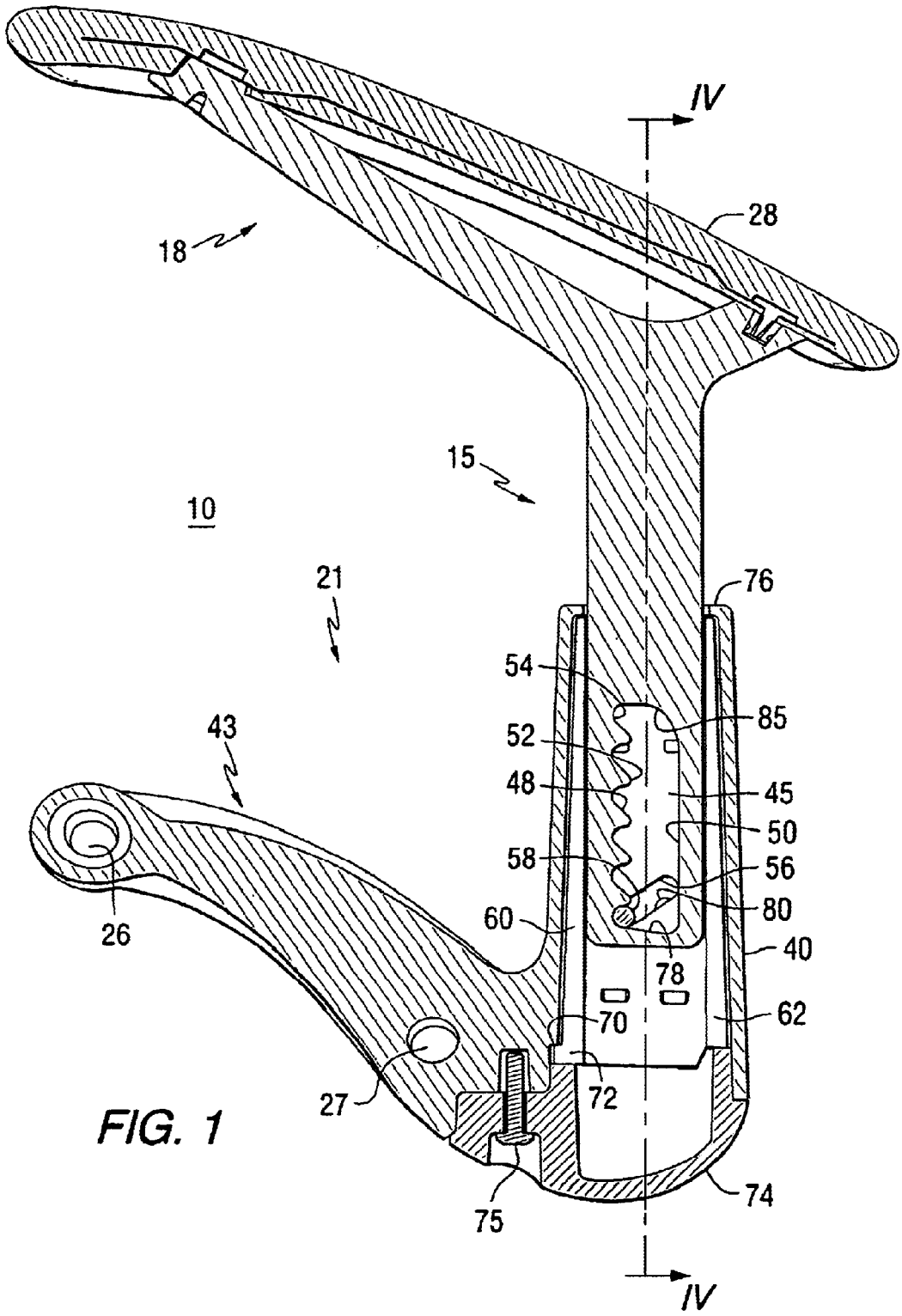
FIG. 1 is a side cross section view of an embodiment of an adjustable armrest assembly according to the invention.
Figure 2:
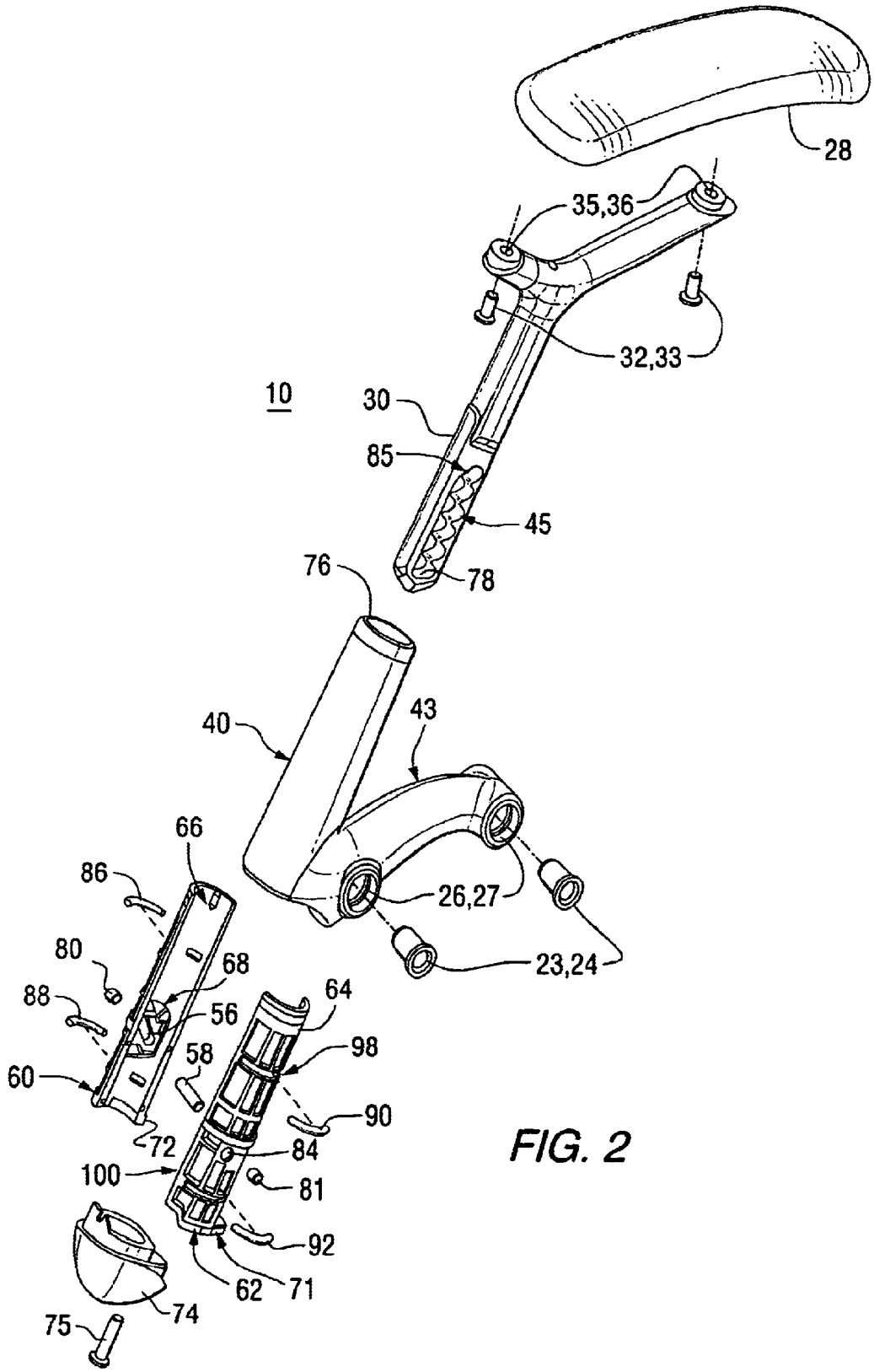
FIG. 2 is a right-hand exploded perspective view of an adjustable armrest assembly such as shown in FIG. 1.

Referring now to the drawing figures, there is illustrated in FIGS. 1 and 2, according to the present invention, an embodiment of a vertically adjustable armrest assembly 10, including an embodiment of a height adjustment mechanism. FIG. 1 is a cross sectional view which shows the main elements of the height adjustment mechanism, more details of which are shown in the exploded views of the armrest assembly 10 in FIGS. 2 and 3. Generally, the adjustable armrest 10 comprises a first, vertically adjustable, wish-bone shaped upper member 15 having an armrest portion 18, and a second, fixed, lower member 21 which can be secured to a chair (not shown). To effect the mounting, for example, a pair of fasteners (not shown) can be inserted through a pair of bushings 23, 24 which are received in corresponding mounting holes 26, 27. The upper member 15 has an arm pad portion 28 and a lower, downwardly extending post portion 30. The arm pad portion 28 is attachable to the upper member 15 via a pair of fasteners 32, 33 and corresponding mounting holes 35, 36 in the upper member. The lower member 21 has a generally vertically oriented housing portion 40 and a generally horizontally oriented portion 43 adapted to be secured to the chair. The post portion 30 of the upper member 15 is slidably received in the hollow housing portion 40 of the second member 21. The post portion 30 is provided with a camming slot 45 near the lower end thereof which is slidably received in the housing 40 of the second member 21. The camming slot 45 is a proportionally narrow slot, elongated in a vertical direction extending along the lower end of the post 30. The camming slot 45 has a series of notches 48 along one side and a generally smooth surface 50 along the opposite side thereof. The notches 48, defined by a series of peaks 52 and valleys 54, are shown having a slight downward orientation, which can facilitate maintaining the armrest in each of the variably adjustable positions, as will be explained more fully hereinafter. However, the orientation could alternatively be upward or generally horizontal, i.e., no downward or upward orientation. The slight downward orientation can make it slightly easier to move the armrest portion 18 between the various notches 48, and can also make it less likely that an unexpectedly large application of downward force on the armrest portion 18 would result in an inadvertent disengagement of the height adjustment mechanism. This will be more fully understood hereinbelow wherein the height adjustment mechanism is described in more detail.

Figure 3:
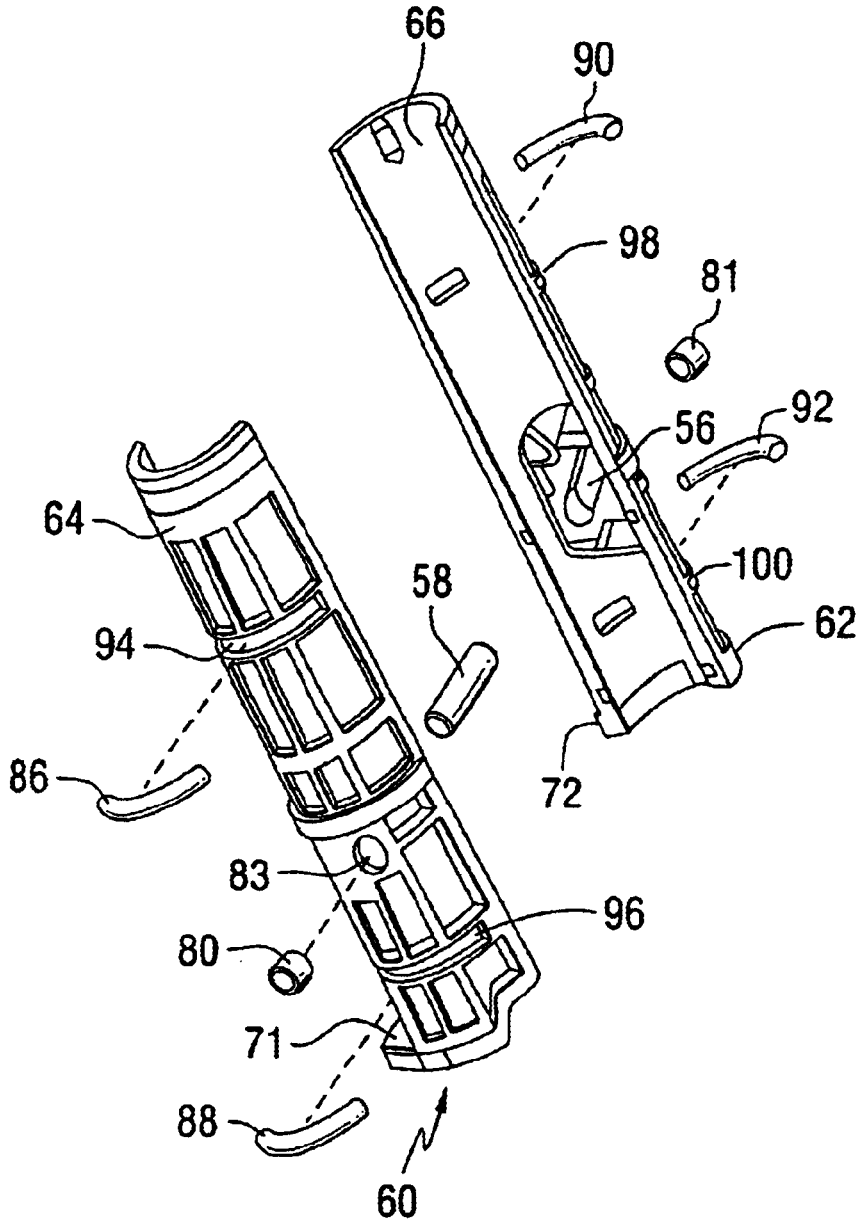
FIG. 3 is a left-hand exploded perspective view of a portion of the adjustable armrest assembly such as shown in FIG. 2.

It can be seen in FIGS. 1 through 3 that there is a second, angularly oriented slot 56 which cooperates with the camming slot 45. A lock pin 58 is also illustrated, which is captured both in the angled slot 56 and the camming slot 45. As can be seen best in FIGS. 2 and 3, right and left hand views, respectively, the angled slot 56 is defined by a pair of sleeve members 60, 62 which are positioned adjacent, and on each side of, the post portion 30 of the upper member 15 of the armrest assembly 10. These sleeve members 60, 62 are captured inside the housing 40 of the lower member 21 of the armrest assembly 10 and surround the outside of the post portion 30. An outer surface 64 of the sleeve members 60, 62 abuts an inner surface of the housing 40, and an inside surface 66 of the sleeve members 60, 62 is held adjacent the post portion 30 by such inner surface. The inside surfaces of the sleeve members 66 surround the post portion 30 and have features 68 therein which define the second, angled slot 56 which cooperates with the camming slot 45 and in which the lock pin 58 is captured.

The sleeves 60, 62 can be secured axially within the housing 40 via upstops 71, 72 at lower end of each sleeve 60, 62, which cooperate with an adjacently located shoulder 70 near the bottom of the housing 40. The upstops 71, 72 coact with the shoulder 70 to prevent the sleeves 60, 62 from being drawn upwards through the top of the housing 40 as the armrest portion 18 is moved upwardly through the enabled range of vertical travel. A bottom cap 74 at the lower end of the housing 40 further secures the sleeves within the housing 40. The bottom cap 74 can be secured to the housing via an appropriate fastener 75. The sleeves 60, 62 could further be secured axially within the housing 40 via a an annular lip 76 at the top end of the housing 40.

The lock pin 58 extends through the camming slot 45 with opposite ends thereof captured in the angled slot 56 defined by the sleeve members 60, 62. The second slot 56 is angled to take advantage of gravity. Essentially, gravity causes the lock pin 58 to seek the lower-most end of the angled slot 56, unless it is otherwise held at a different position therein. Unlike the height adjustment mechanism for a chair back shown in the aforementioned '158 patent, the present angled slot design takes advantage of gravity to control the position of the lock pin 58 in the second slot 56. In the '158 patent, the notches in the camming plate are upwardly oriented to help ensure that the pin won't, either from jarring or by a large application of force, become dislodged from the notch. In the design in the '158 patent the pin is carried by the vertical movable portion and the camming slot is stationary, whereas it is just the opposite in the present invention. Also, in the '158 patent the second slot is generally horizontal, and employs a leaf spring (instead of using gravity) to control the position of the pin in the slot and also to urge the pin into the notches. According to the present invention, the second slot 56 is angled to take advantage of gravity to cause the lock pin 58 to be naturally disposed to take the desired position within the geometry of a notch 48. Thus, a spring or other resiliently deformable member is not needed. The slight downward orientation of the notches 48 can be provided to make it less likely that the lock pin 58 will become dislodged from whichever notch 48 it is engaged in by unintentional movement or an unusually large application of force applied to the top of the armrest portion 18.

The lower-most surface 78 of the camming slot 45 can preferably have a slightly downward sloping orientation to facilitate movement of the lock pin 58 to the upper end of the angled slot 56 in order to fully disengage the lock pin from a notch 48, and move the lock pin 58 to a position adjacent the generally planar side 50 of the camming slot 45. As long as the lock pin 58 is maintained adjacent the planar side 50 of the camming slot 45, the post portion 30, and the armrest portion 18, can be adjusted downwards to the fullest extent, thus resetting the height adjustment mechanism and permitting the adjustment operation to begin again.

In order to facilitate the reset operation, allowing the armrest portion 18 to be moved to the fully lowered position, it can be necessary to maintain the lock pin 58 in the upper-most position in the angled slot 56. To accomplish this, a bushing, and in this embodiment a pair of generally cylindrical bushings 80, 81, are provided, one in each of the sleeve members 60, 62. In each of the sleeve members 60, 62 the bushing 80, 81 is held in a position in which a portion of the bushing 80, 81 projects partially into the angled slot 56 in a manner which segments the angled slot 56 into two separate, upper and lower, regions on either side of bushings 80, 81. The bushings 80, 81 can be disposed in bushing cavities 83, 84 which are provided through the outside surface 64 of the sleeve members 60, 62 and which partially open into the angled slot 56 defined on the inside surface 66 of the sleeve members 60, 62. The inner surface of the housing 40 retains the bushings 80, 81 in the sleeve members 60, 62. As described above, only a portion of the bushings 80, 81 project into the angled slot 56, as permitted, by design, by the partially open end of the bushing cavities in the outside surface 64 of the sleeve members 60, 62 which cooperate with the angled slot 56 on the inside surface 66 thereof. The extent to which the bushings 80, 81 project into the angled slot 56 can be a function of the width of the angled slot 56, the diameter of the lock pin 58, various tolerances, and also can depend upon the material from which the bushings 80, 81 are made. More particularly, the bushings 80, 81 are intended to permit the lock pin 58 to be forcibly displaced past the bushings 80, 81 to an upper-most position at or near the top of the angled slot 56. This can be caused by the angled lower surface 78 of the camming slot 45 in response to drawing the post portion 30 fully upwards. Once in the uppermost position in the angled slot 56, the lock pin 58 will be retained in that position by the bushings 80, 81 until such time as the lock pin 58 is again forcibly urged past the bushings 80, 81 to the lower region of the angled slot 56, at which position the lock pin 58 is again free to engage various notches 48 responsive to vertical movement of the post portion 30.

The lock pin 58 can be forced back across the bushings 80, 81, readying the armrest portion 18 for vertical adjustment once again, when the post 30 is urged all the way to its lower-most position. At this lower-most position, the upper most surface 85 of the camming slot 45 forcibly drives the lock pin 58 back across the bushings 80, 81 into the lower region of the angled slot 56. In this position, the lock pin 58 is ready to again be cycled through each of notches 48 in the camming slot 45 as the armrest portion 18 is adjusted upwardly through its range of motion. Like the lower-most surface 78, the upper-most surface 85 of the camming slot 45 can have a downwardly curving profile which facilitates movement of the lock pin 58 downwardly in the angled slot 56. Both the lower-most surface 78 and the upper-most surface 85 of the camming slot 45 could conceivably be generally horizontal and still accomplish the same function, but it can require more force to be exerted on the post portion in order to urge the lock pin 58 across the bushings 80, 81. Thus, the angled upper 85 and lower 78 most surfaces of the camming slot 45 function via gravity to make the movement of the lock pin 58 across the bushings 80, 81 in the angled slot 56 smoother, and with less required application of force to the armrest portion 18. The bushings 80, 81 can preferably be made of a resiliently compressible material. This can permit the tolerances between the lock pin 58 and the angled slot 56 to be closer since the lock pin 58 can slightly compress the bushings 80, 81 as it is forced thereacross by the angled upper 85 and lower 78 most surfaces of the camming slot 45.

As the armrest portion 18 is moved upwardly through its range of vertical adjustment, the sides of the notches 48 in the camming slot 45 displace the lock pin 58 upwardly in the angled slot 56 just enough to allow the lock pin 58 to clear the notch peak 52, and then fall down, via gravity, into the next notch valley 54. The bushings 80, 81 in the angled slot 56 are located in the angled slot S6 in a position to permit the lock pin 58 to move upward within the angled slot 56 only sufficiently for the lock pin 58 to clear a notch peak 52. In this regard, the extent to which the notch peaks 52 in the camming slot 45 project outwardly, the length of the angled slot 56, and the position of the bushings 80, 81 in the angled slot 56 are each factors which must be considered when designing the mechanism to permit the lock pin 58 to move in the angled slot 56 just sufficiently to clear the notch peaks 52 and drop into the next adjacent notch valley 54.

Figure 4:
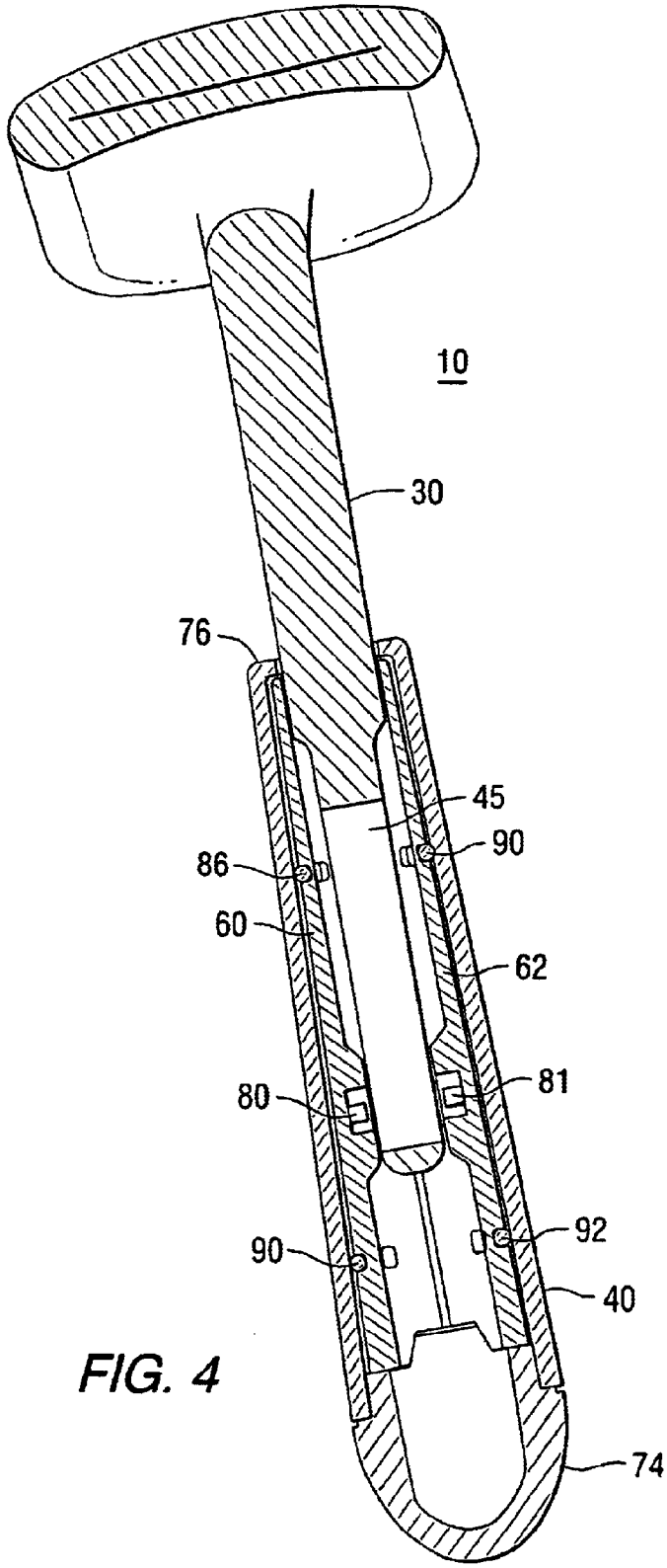
FIG. 4 is a view of the adjustable armrest assembly taken along line IV—IV in FIG. 1.

An additional feature of the sleeve members 60, 62, according to the invention, is the provision of compression members 86, 88, 90, 92 which are provided between the outside surface 64 of the sleeve members 60, 62 and the inner surface of the housing 40, as shown best in FIGS. 3 and 4. These compression members 86, 88, 90, 92 can be located in annular grooves 94, 96, 98, 100 provided on the outside surface 64 of the sleeve members 60, 62. The annular grooves 94, 96, 98, 100 can help to hold the compression members 86, 88, 90, 92 in position and inhibit migration of the compression members 86, 88, 90, 92, such as could be induced by vibrations from the operation of the height adjustment mechanism. In the embodiment shown, a pair of vertically spaced compression members 86, 88, 90, 92, are provided on the outside surface 64 of each sleeve member 60, 62. The compression members 86, 88, 90, 92 can be designed to create a close fit between the sleeve members 60, 62 and the housing 40 by absorbing tolerances, and eliminating play between the post 30, sleeve members 60, 62, and the housing 40. A loose fit can result in undesirable wobbling of the post 30 within the housing 40, particularly when the armrest portion 18 is at the fully vertically extended position.

Figure 5:
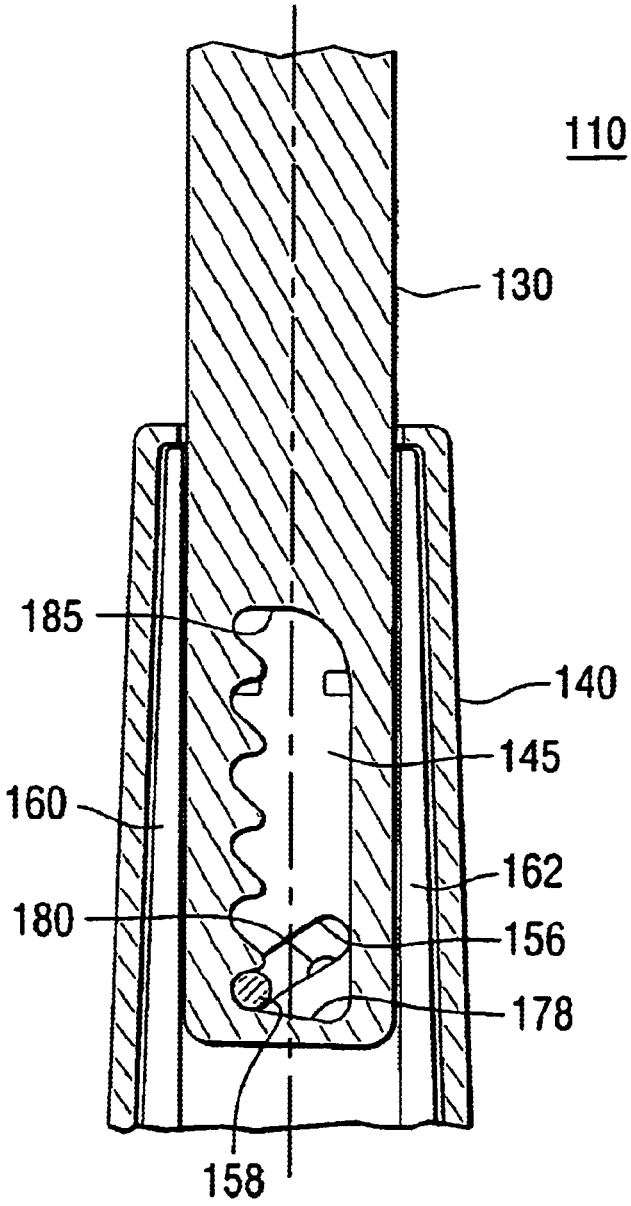
FIG. 5 is a side cross section view of an embodiment of a height adjustment mechanism according to the invention.
Figure 7:
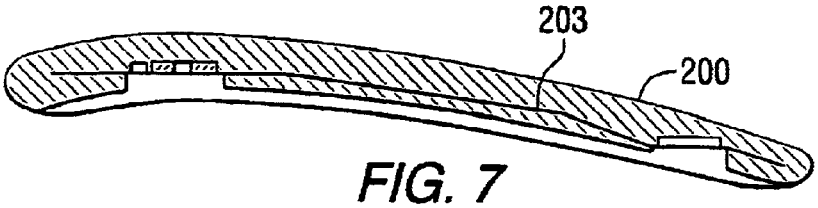
FIG. 7 is a section view of the arm pad taken along line VII—VII in FIG. 6.

Referring now to FIG. 5, an embodiment of a height adjustment mechanism 110 is illustrated, which can basically comprise the same elements as height adjustment mechanism described previously in connection with FIGS. 1 through 4. In accordance with the aforesaid description, the height adjustment mechanism 110 shown can comprise a post portion 130 slidably disposed in a housing portion 140, a camming slot 145 formed in the post portion 130, and sleeve members 160, 162 intermediate the post portion 130 and housing 140. The sleeve members 160, 162 can be generally identical to the sleeve members 60, 62 shown in FIGS. 1-4, including features on the inner surfaces thereof adjacent the camming slot 145 which form a second, angled slot 156 on opposite sides of the camming slot 145. A locking pin 158 is similarly disposed through both the camming 145 and angled slots 156, with opposite ends thereof captured in the angled slot 156. Likewise bushings 180 and 181 (not visible) are provided projecting at least partially into the angled slot 156 to define upper and lower regions in the angled slot 156. The camming slot 145 includes upper 185 and lower 178 surfaces for moving the locking pin 158 between the two regions defined by the bushings 180, 181. Additionally, as with the sleeve members 60, 62, compression members (not visible) can also be provided between an outer surface of the sleeve members 160, 162 and the inside of the housing 140, for the same purposes described in connection with FIGS. 1-4. Essentially, the height adjustment mechanism shown can comprise the same members and function in the same manner as described in connection with the adjustable armrest assembly 10.

Thus the height adjustment mechanism 110, as will be apparent to one of ordinary skill in the art, as described heretofore, is not to be limited to use only in an armrest of a chair. Especially in view of the '158 patent, the height adjustment mechanism 110 could also be used for a vertically adjustable backrest. Although illustrated in FIGS. 1-4 as having a round, or oval cross section, the height adjustment mechanism 110 could be made having a flatter, more narrow, shape as may be more desirable if incorporated into the backrest of a chair. Moreover, it is also conceivable that the height adjustment mechanism 110 may possibly have application for vertical adjustment of the seat of a chair.

Accordingly, the height adjustment mechanism 110 can have essentially the same components as the height adjustment mechanism for the adjustable armrest assembly 10 described in connection with FIGS. 1-4, but the post portion 130 could be part of an upper member (not shown) which could be the upper part of a chair backrest or the underside of a chair seat. Likewise, the housing portion 140 could be part of a lower member (not shown) which could be the lower part of a chair backrest or the base of a chair.

Figure 6:
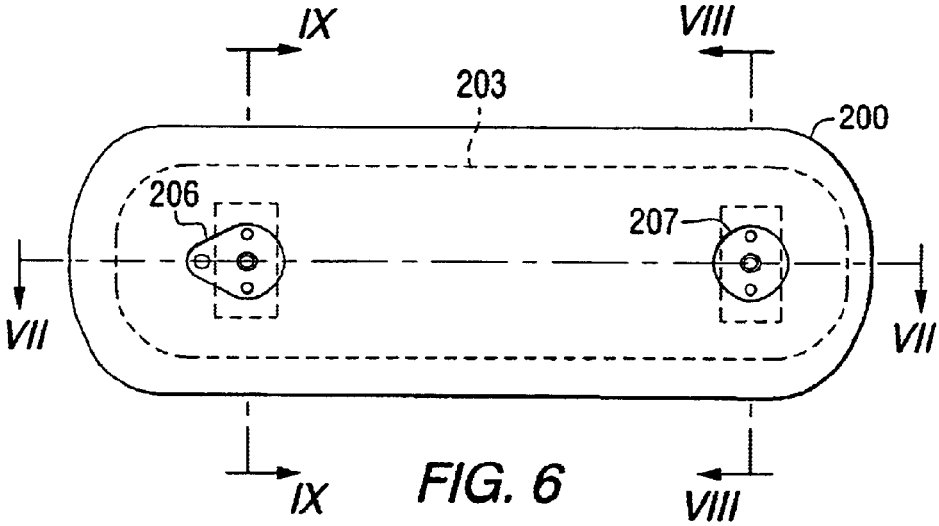
FIG. 6 is a bottom view of an embodiment of an arm pad for an adjustable armrest assembly.
Figure 8:
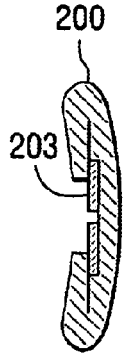
FIG. 8 is a section view of the arm pad taken along line VIII—VIII in FIG. 6.
Figure 9:
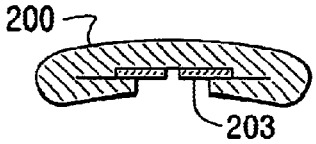
FIG. 9 is a section view of the arm pad taken along line IX—IX in FIG. 6.
Figure 10:
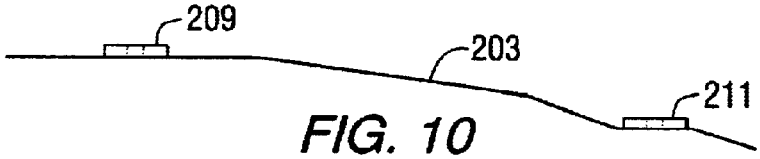
FIG. 10 is a side view of an embodiment of a spring member for the arm pad shown in FIG. 6.
Figure 11:
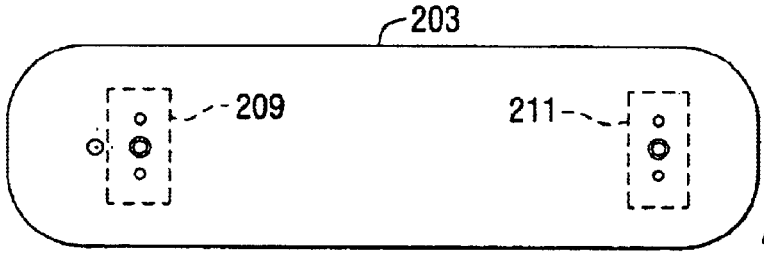
FIG. 11 is a bottom view of the spring member shown in FIG. 10.

Referring now to FIGS. 7 through 11, an embodiment of an arm pad 200 according to the invention is shown having a resiliently flexible insert 203. The arm pad 200 can be similar to the arm pad portion 28 shown in FIG. 1. The insert 203 can be molded into the arm pad 200, and can be made from, for example, spring steel, or an appropriate plastic or other material having resiliently flexible properties. The insert 203 can be a thin plate-like member, and can be attached to the arm pad 200 at front and rear portions thereof via mounting portions 206, 207, provided on an underside of the arm pad 200, and appropriate fasteners (not shown). To facilitate fastening the insert 203 to the arm pad 200, raised mounting surfaces 209, 211 can be provided on the insert 203, such as, for example, the two mounting portions 209, 211, shown best in FIGS. 10 and 11. The mounting portions 209, 211 mate with corresponding mounting surfaces 206, 207 on the arm pad 200. The insert 203 can be generally oval shaped, also shown best in FIGS. 6 and 11, and can preferably have the profile shown in FIG. 10. The insert 203 imparts a firm, yet flexible property to the arm pad 200, enhancing comfort and resiliency.

Although certain embodiments of the invention have been described in detail, it will be appreciated by those skilled in the art that various modifications to those details could be developed in light of the overall teaching of the disclosure.

Accordingly, the particular embodiments disclosed herein are intended to be illustrative only and not limiting to the scope of the invention which should be awarded the full breadth of the following claims and any and all embodiments thereof.

What is claimed is:

1. An adjustable armrest assembly comprising:

a. a fixed member having a chair attachment portion and a housing portion;

b. a vertically adjustable member having an armrest portion and a post portion, said post portion having a lower end thereof slidably disposed in said housing portion, said vertically adjustable member selectively movable between a fully raised position, a fully lowered position, and at least one intermediate position;

c. a sleeve member disposed in said housing, said sleeve member having an inner surface adjacent said lower end of said post portion and an outer surface adjacent an inside surface of said housing portion; and d. a height adjustment mechanism comprising a camming slot formed in said lower end of said post portion, an angled slot formed in said inner surface of said sleeve member on opposite sides of said camming slot, a locking pin operably positioned through each of said camming and angled slots with opposite ends of said locking pin slidably captured in said angled slot, and a bushing member projecting at least partially into said angled slot, said bushing member defining upper and lower regions of said angled slot, said camming slot having a plurality of notches on one side and a generally planar surface on an opposing side, said upper region of said angled slot adjacent said generally planar surface and said lower region adjacent said plurality of notches, said camming slot having top and bottom surfaces, said top surface forcing said locking pin across said bushing member into said lower region of said angled slot at said fully lowered position, said bottom surface forcing said locking pin across said bushing member into said upper region of said angled slot at said fully raised position, said locking pin being maintained in one of said upper and lower regions by said bushing member until said locking pin is caused to move across said bushing member by said bottom and top surfaces, when said locking pin is in said lower region of said angled slot gravity urges said locking pin toward said plurality of notches, such that said locking pin is urged into one of said plurality of notches when such becomes aligned with said lower region, wherein said locking pin is movable from said one notch responsive to upward vertical movement of said post portion such that said vertically adjustable member is held at a height corresponding to said one notch until further upward vertical movement of said post portion moves said locking pin from said one notch.

2. The adjustable armrest assembly of claim 1 further comprising at least one compression member disposed between said outer surface of said sleeve member and said inside surface of said housing portion.

3. The adjustable armrest assembly of claim 1 wherein said sleeve member further comprises a pair of sleeve members.

4. The adjustable armrest assembly of claim 3 further comprising at least one compression member disposed between said outer surface of each of said pair of said sleeve member and said inside surface of said housing portion.

5. The adjustable armrest assembly of claim 1 wherein:

a. said bushing member further comprises a pair of bushing members;

b. said sleeve member further comprises a bushing cavity at least partially opening into said angled slot on said opposite sides of said camming slot such that each of said pair of bushing members at least partially projects into said angled slot to define said upper and lower regions; and c. wherein said pair of bushing members are engageable only with said opposite ends of said locking pin which are captured in said angled slot.

6. The adjustable armrest assembly of claim 5 wherein said sleeve member further comprises a pair of sleeve members and each of said pair of bushing members is associated with a respective one of said pair of sleeve members.

7. The adjustable armrest assembly of claim 1 further comprising an arm pad securable to said armrest portion, said arm pad having a resiliently flexible insert member.

8. The adjustable armrest assembly of claim 7 wherein said resiliently flexible insert member is a thin plate-like member having a width and length substantially the same as the arm pad.

9. The adjustable armrest assembly of claim 8 wherein said thin plate-like member is made from spring steel.

10. A height adjustment mechanism comprising:

a. a first member having a housing portion and a support portion;

b. a second vertically adjustable member having an upper end and a lower end, said lower end slidably disposed in said housing portion, said lower end having a camming slot formed therein, said camming slot having a plurality of notches on one side thereof and a generally planar surface on an opposing side, said vertically adjustable member selectively movable between a fully raised position, a fully lowered position, and at least one intermediate position;

c. a sleeve member disposed in said housing, said sleeve member having an inner surface adjacent said camming slot and an outer surface adjacent an inside surface of said housing portion, said sleeve member having an angled slot formed in said inner surface on opposite sides of said camming slot;

d. a locking pin operably positioned through each of said camming and angled slots with opposite ends of said locking pin slidably captured in said angled slot;

e. a bushing member projecting at least partially into said angled slot, said bushing member defining upper and lower regions of said angled slot, said upper region of said angled slot adjacent said generally planar surface of said camming slot and said lower region adjacent said plurality of notches;

f. said camming slot further having top and bottom surfaces, said top surface forcing said locking pin across said bushing member into said lower region of said angled slot at said fully lowered position, said bottom surface forcing said locking pin across said bushing member into said upper region of said angled slot at said fully raised position, said locking pin being maintained in one of said upper and lower regions by said bushing member until said locking pin is caused to move across said bushing member by said bottom and top surfaces;

g. when said locking pin is maintained in said lower region of said angled slot gravity urges said locking pin toward said plurality of notches, such that said locking pin is urged into one of said plurality of notches when such becomes aligned with said lower region; and h. wherein said locking pin is moveable from said one notch responsive to upward vertical movement of said post portion such that said vertically adjustable member is held at a height corresponding to said one notch until additional upward vertical movement of said post portion moves said locking pin from said one notch.

11. The height adjustment mechanism of claim 10 further comprising at least one compression member disposed between said outer surface of said sleeve member and said inside surface of said housing portion.

12. The height adjustment mechanism of claim 10 wherein said sleeve member further comprises a pair of sleeve members.

13. The height adjustment mechanism of claim 12 further comprising at least one compression member disposed between said outer surface of each of said pair of said sleeve member and said inside surface of said housing portion.

14. The height adjustment mechanism of claim 10 wherein:

a. said bushing member further comprises a pair of bushing members;

b. said sleeve member further comprises a bushing cavity at least partially opening into said angled slot on said opposite sides of said camming slot such that each of said pair of bushing members at least partially projects into said angled slot to define said upper and lower regions; and c. wherein said pair of bushing members are engageable only with said opposite ends of said locking pin are captured in said angled slot.

15. The height adjustment mechanism of claim 14 wherein said sleeve member further comprises a pair of sleeve members and each of said pair of bushing members is associated with a respective one of said pair of sleeve members.

* * * * *